US005469605A

United States Patent [19]

Horikawa

[11] Patent Number: 5,469,605

[45] Date of Patent: Nov. 28, 1995

[54] SLIDE FASTENER

[75] Inventor: Mitsuo Horikawa, Toyama, Japan

[73] Assignee: Yoshida Kogyo K.K., Tokyo, Japan

[21] Appl. No.: 213,084

[22] Filed: Mar. 15, 1994

[30] Foreign Application Priority Data

Mar. 16, 1993 [JP] Japan ..... 5-011496 U

[51] Int. Cl.[6] ..... A44B 19/02

[52] U.S. Cl. ..... 24/403; 24/405; 24/413; 139/384 B; 139/425 R

[58] Field of Search ..... 139/384 B, 425 R; 24/403, 405, 406, 407, 408, 413, 414

[56] References Cited

U.S. PATENT DOCUMENTS

| | | | |
|---|---|---|---|
| 2,205,570 | 7/1940 | Lewis . | |
| 2,236,033 | 3/1941 | Killmer | 139/384 B |
| 2,264,324 | 12/1941 | Morin | 24/413 X |
| 2,264,325 | 12/1941 | Morin | 24/413 X |
| 2,264,326 | 12/1941 | Morin | 24/413 X |
| 2,264,327 | 12/1941 | Morin | 24/413 |
| 2,264,580 | 12/1941 | Morin | 24/403 X |
| 3,132,398 | 5/1964 | Schwendt et al. | 24/408 |
| 5,297,319 | 3/1994 | Akashi et al. | 24/413 X |

FOREIGN PATENT DOCUMENTS

| | | |
|---|---|---|
| 541059 | 5/1993 | European Pat. Off. . |
| 831191 | 8/1938 | France . |
| 192858 | 11/1937 | Switzerland . |
| 500905 | 6/1938 | United Kingdom . |
| 501470 | 2/1939 | United Kingdom . |

*Primary Examiner*—James R. Brittain
*Attorney, Agent, or Firm*—Hill, Steadman & Simpson

[57] ABSTRACT

A slide fastener which permits easy attachment of electric conductors and ensures supply of electric current to all metallic coupling elements even if a part of the electric conductors is cut off. And it has a neat appearance because the electric conductors exposed in spaces among the coupling elements do not look unsightly. In the slide fastener having a fastener tape, a core cord and metallic coupling elements disposed along a longitudinal edge of one side of the fastener tape, a plurality of electric conductors are used as a part of warps of the fastener tape, and the exposed portions of the electric conductors are shifted one another in the longitudinal direction. Therefore, the electric conductors are substantially continuously exposed on the front surface of the fastener tape along the outer edge of the core cord and weaved in the fastener tape body.

6 Claims, 3 Drawing Sheets

SLIDE FASTENER

BACKGROUND OF THIS INVENTION

1. Field of the Invention

This invention relates to a slide fastener provided with metallic coupling elements onto which electro-chemical surface treatment such as anodized film forming, electrolytic plating, electrodeposition coating or the like is carried out.

2. Prior Art

In the slide fastener with a plurality of metallic coupling elements attached at regular intervals along the longitudinal edge of one side of the fastener tape, when electro-chemical surface treatment such as anodized film forming, electrolytic plating, electrodeposition coating or the like is carried out for each metallic coupling element, it is required to apply an electric current to each of the metallic coupling element. Therefore, electric conductors are arranged along the longitudinal edge of one side of the fastener tape provided with the coupling elements.

The prior art exemplifying the slide fastener having the electric conductors arranged along its edge are disclosed, for example, in Japanese Utility Model Publication No. S59-27136 and in the U.S. Pat. No. 2264324. According to the disclosed structure, the electric conductors are attached on and along the core cord of the fastener tape or wound helically around the core cord, so that they are protruded on the surface of the core cord.

In die-casting of metallic coupling elements, the fastener tape is sandwiched between upper mad lower metal molds to cast plural coupling elements at regular intervals therealong. Then, concave grooves are formed between cavities of the upper and lower metal molds for fastener coupling elements to fit the longitudinal edge of one side of the fastener tape therein. When the longitudinal edge of one side of the fastener tape is inserted into the concave grooves, electric conductors protruded on the front surface must cut into the core cord without protruding from the concave grooves and the upper and lower metal molds must be firmly contacted with each other in clamping thereof.

However, with the prior art examples, the protruded electric conductors might be cut off by being not completely received in the concave grooves and sandwiched between the edges of the concave grooves of the upper and lower metal molds. Therefore, it was impossible to carry out the successive electrolytic plating.

In the metallic coupling elements of pressed products, a plurality of fastener coupling elements are planted at regular intervals by caulking their legs while the electric conductors are attached along the longitudinal edge of the cord side of the fastener tape. Unlike the above-mentioned cast-molding, this process has higher probability that the electric conductors protruded on the fastener tape are cut off because the caulking force is necessarily applied to all coupling elements exerting the pressure upon the cord. Therefore, poor current application may be caused more often than the casting process.

SUMMARY OF THE INVENTION

It is therefore a primary object of this invention to overcome the above mentioned problems and to provide a slide fastener wherein an electric current can be applied to all of the metallic coupling elements since poor current application is not generated even if a part of electric conductors is cut off, and which provides a beautiful appearance since the electric conductors exposed in spaces among the coupling elements do not look unsightly.

According to this invention, the slide fastener having a fastener tape, a core cord weaved integrally in a longitudinal edge of one side of the fastener tape and metallic coupling elements disposed at regular intervals along the longitudinal edge of the fastener tape comprises plural electric conductors which are used as a part of warps of said fastener tape, and of which exposed portions are shifted one another in the longitudinal direction, so that the electric conductors are substantially continuosly exposed along an outer edge of the core cord, being weaved in the fastener tape body.

According to the slide fastener of this invention, since at least two electric conductors are alternately exposed in the longitudinal direction along an outer edge of the selvage for covering a core cord, the electric conductors may be substantially continuously exposed throughout the length of the fastener tape. The electric conductor weaved integrally in the fastener tape is always maintained linearly along the outer edge of the core cord without slipping sideways on the fastener tape because it is used as a warp to constitute a part of the textile. Further, a conductive copper foil or wire is wound helically on the periphery of proper fibrous yarns to produce the electric conductor provided with flexibility. Thus, the electric conductor is used as the usual warp to constitute a part of a textile and weaved integrally in the fastener tape, so that the electric conductor is not protruded from the front side of the textile. Since the electric conductors are weaved as a part of textile being protected by warps and wefts and are not protruded from the front surface of the textile, the electric conductors can be protected from being damaged in the molding of the coupling elements. And since the electric conductors expose along whole length of the edge portion, the electric conductors can contact with all of the coupling elements, A plurality of coupling elements attached at regular intervals to the selvage of the fastener tape are necessarily contacted with the electric conductors so that the successive electro-chemical surface treatment can be surely carried out. Even when one of plural electric conductors is cut off, the electric current is properly supplied unless other electric conductors are cut off, so that the successive electrical surface treatment process can be smoothly carried out without inconveniences. The electric current can be supplied to all of the metallic coupling elements to promote the yield in manufacturing the slide fastener.

Moreover, in attaching of coupling elements, even when local large load is applied to the core cord portion of the fastener tape, the electric conductors are protected from being damaged by usual warps and wefts of the periphery thereof. The electric conductors weaved in the longitudinal edge of the fastener tape do not appear unsightly so that the slide fastener has a neat appearance.

Furthermore, in manufacturing the slide fastener, the processes for winding electric conductors around a core cord or for attaching the electric conductors to the core cord can be omitted and the electric conductors may be arranged in the fastener tape during weaving, so as to decrease the cost of production sharply.

The above and other objects, features and advantages of this invention will become manifest to those versed in the art upon making reference to the detailed description and the accompanying drawings in which preferred structural embodiments incorporating the principles of this invention are shown by way of illustrative example.

DETAILED DESCRIPTION OF THE PREFERRED EMBODIMENTS

Figure 1:
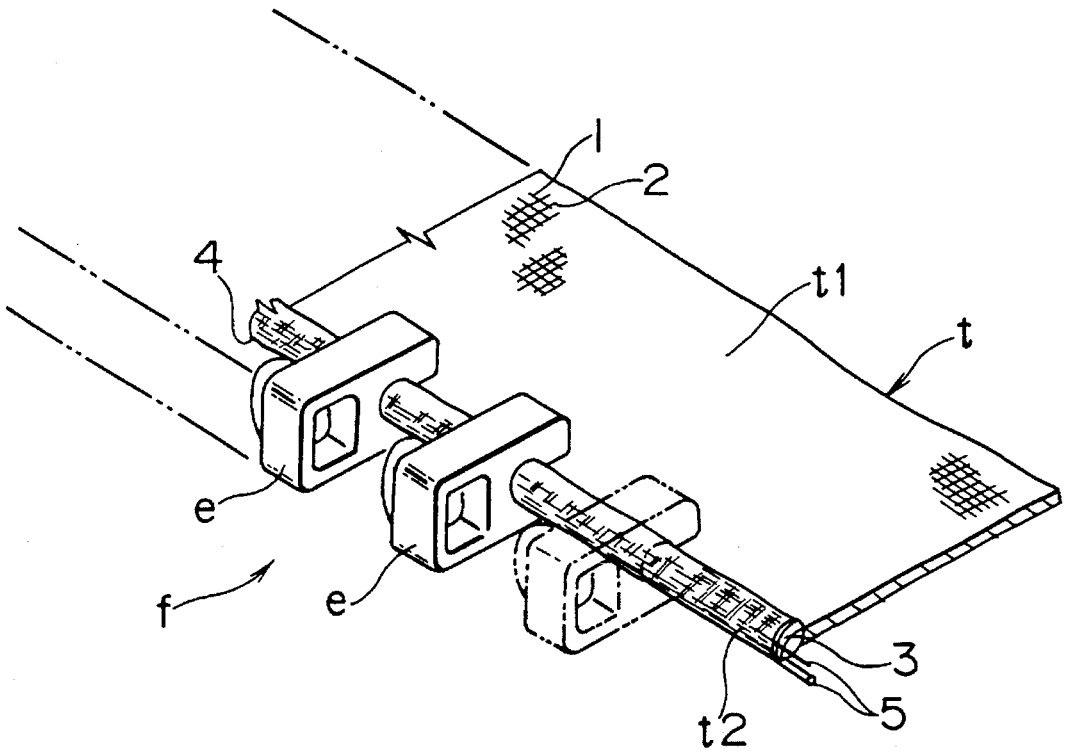
FIG. 1 is a fragmentary perspective view for showing an appearance of a fastener/stringer which is adapted in a slide fastener of this invention.

Preferred embodiments of this invention will be illustrated in detail with reference to accompanying drawings. FIG. 1 shows a fragementary perspective view of a typical example of a fastener stringer f made by weaving of this invention. The fastener tape t is weaved with warps 1 and wefts 2 to provide a circular textile design on a longitudinal edge of one side of a tape body t1. Then, a core cord 3 is disposed in the circular textile design in a longitudinal direction at the time of the weaving. Two electric conductors 5 are arranged as warps for the wefts 2 of outer edges 4 of selvages to weave the tape body t1. Then, the electric conductors 5 are exposed on the tape body t1 when the wefts 2 extend under the electric conductors 5. When the wefts 2 are exposed on the tape body t1, the electric conductors 5 extend under the wefts 2.

Figure 2:
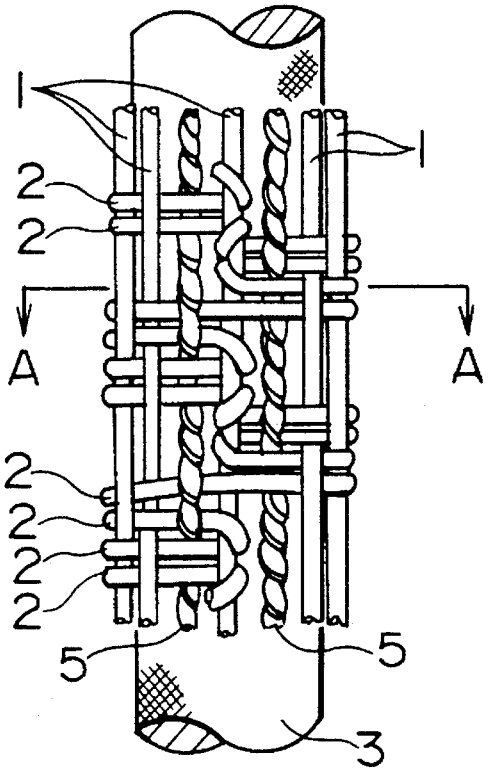
FIG. 2 is a front view for showing an example of textile design looking from the core cord side of a fastener tape of a first embodiment of the invention.
Figure 4:
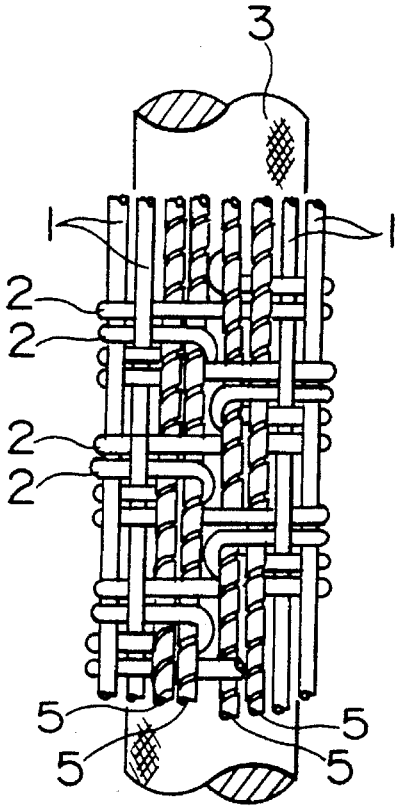
FIG. 4 is a front view for showing an example of textile design looking from the core cord side of a fastener tape of a second embodiment of this invention.

According to this invention, as shown in FIG. 2 and FIG. 4, at least two electric conductors 5 are used. A plurality of electric conductors 5 are exposed in order as the exposed portions of the electric conductors are mutually shifted. The above-mentioned design is repeated, so that the electric conductors 5 are substantially continuously exposed along the whole longitudinal length of the tape body t1. The fastener tape t may be weaved by the conventional textile design.

Figure 3:
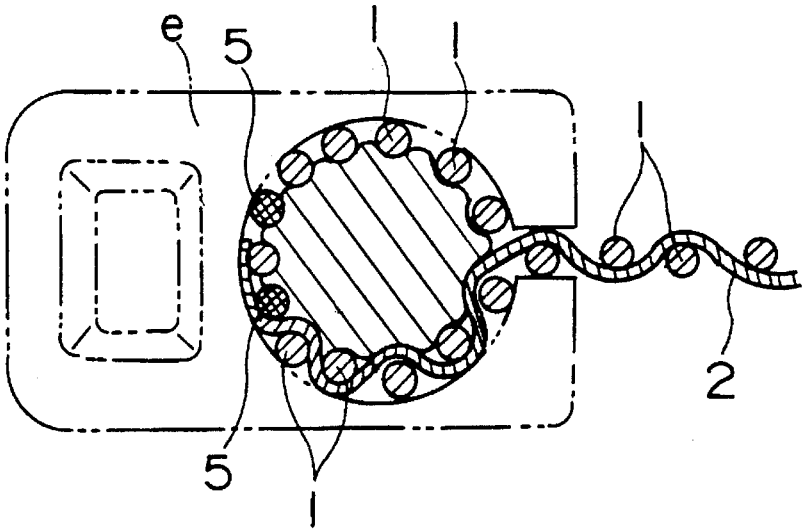
FIG. 3 is a fragmentary cross-sectional view taken along the line A—A FIG. 2.

First and second embodiments of this invention are illustrated in detail respectively with reference to FIG. 2 and FIG. 3 and to FIG. 4. A plurality of warps 1 and double-pick wefts 2 are weaved to provide a twill structure of a tape body t1. One longitudinal edge of the tape body t1 is weaved to provide a circular-weaved portion t2 as above-mentioned. And, a core cord 3 is disposed in the circular-weaved portion t2. The textile design of the circular-weaved portion t2 of the fastener tape t in this invention is by no means limited to the one shown in the drawings.

In the textile design of the circular-weaved portion t2 shown in FIG. 2 and FIG. 4, double-pick wefts 2 are effectively used to compose the textile design. Plural electric conductors 5 are arranged in the turn portion of the wefts 2 or in the outer edge of the circular-weaved portion t2 (two electric conductors are shown in FIG. 2 and four electric conductors are shown in FIG. 4). The textile design of the circular-weaved portion t2 has a special basic design that a part of the double-pick wefts 2 are turned and intertwisted with the warps 1 or the electric conductors 5 rand the adjacent other double-pick wefts 2 are turned around along half circumference of the core cord 3. Of course, wefts 2 are weaved together with plural warps 1 arranged in front and back of electric conductors 5 to provide a normal textile design.

That is, a plurality of warps 1 are arranged to enclose the periphery of the core cord 3 in the portion for constituting the circular-weaved portion t2 of the fastener tape t as shown in FIG. 2 and FIG. 3 as the first embodiment. Two electric conductors 5 are arranged as warps in the outer edge of the fastener tape t and one warp 1 is disposed between the electric conductors 5.

The weft weaving design with the arrangement of warps 1 and electric conductors 5 will be described in order from the upper part to the lower part of FIG. 2. First weft 2 is weaved into warps 1 from the left side of the drawing and strides over a left electric conductor 5 and extends under a central warp 1. The weft 2 is inter-twisted with the central warp 1 and is turned onto the front side, and after it is again weaved into plural warps 1, it is weaved into a tape body t1 to provide a twin yarn state. Second weft 2 is weaved into the warps 1 from the left side of the drawing as well as the first weft 2 and strides over the left electric conductor 5 and reaches the central warp 1. The second weft 2 is intertwisted with the central warp 1 for one circumference running toward the right side. After it goes under the right electric conductor 5 and weaved into plural warps 1 of the right side, it is weaved into the tape body t1 at the twin yarn state. Third weft 2 is weaved into the warps 1 from the right side of the drawing and extends under the right electric conductor 5 and the central warp 1. The third weft 2 is intertwisted with the central warp 1 and turned around toward the front side and then it is weaved into plural warps 1 in the right side of the drawing, and it is also weaved into the tape body t1 at the twin yarn state. Fourth weft 2 weaved from the left side extends under the left electric conductors 5 and after it strides over the central warp 1 and the right electric conductor 5, it is weaved into a plurality of warps 1 of the right side and weaved into the tape body t1. The basic design is made of four wefts and the same design is continuously repeated.

Sebsequently, the design of the circular-weaving portion t2 of the fastener tape t of the second embodiment will be illustrated with reference to FIG. 4. The second embodiment has the same basic textile design as the first embodiment, however, it is different from the first embodiment in that the central warp is omitted and four electric conductors 5 are arranged in parallel. That is, double-pick weft 2 is intertwisted with the electric conductor 5 for one circumference to provide the circular-weaved portion t2.

With the fastener tape t according to this invention, adjacent electric conductors 5 are weaved in parallel along the outer edge of the circular-weaved portion 2 in which a core cord 3 is disposed. The adjacent electric conductors 5 are mutually shifted for predetermined length in the longitudinal direction and exposed in order on the wefts 2, so that the the electric conductors are substantially continuously exposed on the wefts 2 throughout the whole length of the fastener tape t.

Figure 5:
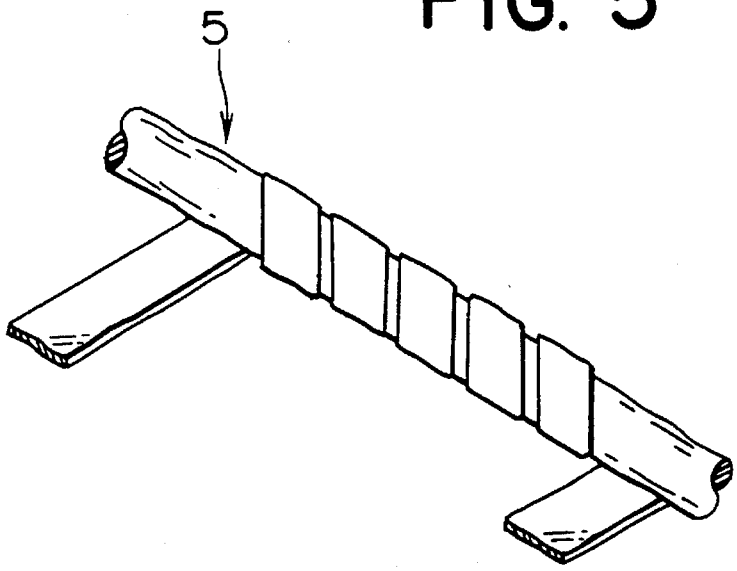
FIG. 5 is a perspective view of the structure of electric conwhich is adapted in the fastener tape of this invention.

The electric conductor 5 is made of flexible fibrous yarns and conductive aluminum or copper foil or wire spirally wound on the periphery of flexible fibrous yarns to form a conductive metal surface as shown in FIG. 5. The conductive metal surface may be formed by depositing aluminum or copper onto the flexible fibrous yarns. And the electric conductors may even made of flexible conductive aluminum or copper. The electric conductor 5 is used as well as the other warp to provide a part of fastener tape textile, so that the electric conductor 5 is not protruded from the front surface of the textile. Since the electric conductor 5 integrally weaved in the fastener tape t is used as the warp to constitute a part of textile, it does not slip sideways in the width direction of the fastener tape t and is always maintained linearly along the outer edge of the core cord 3. The fibrous yarn used in the electric conductor 5 is made of a beat-resistance fiber when the beat-resistance is required. The fibrous yarn is made of a shrinkable or stretch fiber when the spirally wound conductive material should be tightly arranged on the fibrous yarn. The fibrous yarn can be properly selected from various materials according to the desired functions.

In setting the fastener tape between die cast forming metal molds to mold coupling elements, even if the core cord is sandwiched between edges of concave grooves of the metal moulds, the electric conductor is prevented from being damaged. Even if one of plural electric conductors 5 is cut off, the electric current can be applied to other electric conductors which are not cut, so that the electric current can be surely supplied to all coupling elements e in the successive electrolytic plating process.

When pressed coupling elements e are planted on a fastener tape t, all of the coupling elements e are surely contacted with the electric conduct or 5, since the electric conductor 5 is exposed on the same surface as the other warps 1. Even if one of plural electric conductors 5 is cut while planting the coupling elements e, the electric current can be properly supplied to the coupling elements as far as other electric conductors 5 are not cut off as well as die cast forming, so that the successive surface treatment can be smoothly carried out.

Obviously, various modifications and variations of this invention are possible in the light of the above teaching. It is therefore to be understood that, within the scope of the appended claim, the invention may be practiced otherwise than as specifically described.

What is claimed is:

1. A slide fastener having a fastener tape, a core cord weaved integrally in a longitudinal edge of one side of said fastener tape and metallic coupling elements disposed at regular intervals along the longitudinal edge of the fastener tape comprising plural electric conductors which are used as a part of warps of said fastener tape, at least two of said electric conductors having exposed portions which are shifted from one another in the longitudinal direction, so that said electric conductors are substantially continuously exposed along an outer edge of said core cord, being weaved in said fastener tape body.

2. A slide fastener according to claim 1, using two electric conductors which are arranged one by one as a part of warps in the textile design.

3. A slide fastener according to claim 1, using four electric conductors which are arranged two by two as a part of warps in the textile design.

4. A slide fastener according to claim 1, wherein said electric conductors are made of flexible fibrous yarn covered with conductive aluminum or copper.

5. A slide fastener according to claim 1, wherein said electric conductors are made of conductive aluminum or copper.

6. A slide fastener according to claim 4, wherein said flexible fibrous yarns used in said electric conductors are made of heat-resistance fibers.

* * * * *